US009758278B2

(12) United States Patent
Riboli et al.

(10) Patent No.: US 9,758,278 B2
(45) Date of Patent: Sep. 12, 2017

(54) PACKAGING SLEEVE FOR A BOTTLE

(71) Applicant: San Antonio Winery, Inc., Los Angeles, CA (US)

(72) Inventors: Steven Riboli, Sierra Madre, CA (US); Dante Colombatti, San Marino, CA (US); Jessica Macaranas, Wildomar, CA (US); Jose Martinez, Jr., Whittier, CA (US); Cheryl Ann Livingston, Yorba Linda, CA (US); Andrew R. Tosh, Newport Beach, CA (US); Michael A. Smith, Ontario, CA (US)

(73) Assignee: San Antonio Winery, Inc., Los Angeles, CA (US)

( * ) Notice: Subject to any disclaimer, the term of this patent is extended or adjusted under 35 U.S.C. 154(b) by 30 days.

(21) Appl. No.: 14/543,802

(22) Filed: Nov. 17, 2014

(65) Prior Publication Data

US 2016/0137347 A1 May 19, 2016

(51) Int. Cl.

| | |
|---|---|
| ***B65D 25/00*** | (2006.01) |
| ***B65D 65/00*** | (2006.01) |
| ***B65D 75/00*** | (2006.01) |
| ***B65D 85/00*** | (2006.01) |
| ***B65D 85/72*** | (2006.01) |
| ***B65D 23/08*** | (2006.01) |
| ***B65D 65/08*** | (2006.01) |
| ***B65D 65/04*** | (2006.01) |
| ***B65D 5/62*** | (2006.01) |
| ***B65D 5/50*** | (2006.01) |
| ***B65D 5/02*** | (2006.01) |
| ***B65B 11/54*** | (2006.01) |

(52) U.S. Cl.

CPC ..... *B65D 23/0842* (2013.01); *B65D 5/0209* (2013.01)

(58) Field of Classification Search

CPC B65D 85/72; B65D 23/0842; B65D 23/0857; B65D 23/08; B65D 65/08; B65D 65/04; B65D 5/62; B65D 5/5007; B65D 5/0209; B65B 11/54

USPC ..... 229/4.5, 89

See application file for complete search history.

(56) References Cited

U.S. PATENT DOCUMENTS

| | | | | |
|---|---|---|---|---|
| 847,648 | A | 3/1907 | Carnahan | |
| 2,081,409 | A | 5/1937 | Rush | |
| 2,221,310 | A | 11/1940 | Gazelle | |
| 2,884,181 | A * | 4/1959 | McCormick | B65D 5/5007 206/426 |
| 3,967,995 | A * | 7/1976 | Fabianic | B65B 21/245 156/198 |
| D379,303 | S | 5/1997 | Broye | |
| D392,512 | S | 3/1998 | Bennett et al. | |
| 5,881,868 | A * | 3/1999 | Soyak | A24F 15/00 206/213.1 |

(Continued)

OTHER PUBLICATIONS

Thomson CompuMark Trademark Research Report regarding Design of Wrapping/Sleeve/Paper Bag for Bottle dated Oct. 14, 2014.

*Primary Examiner* — Andrew T Kirsch

(74) *Attorney, Agent, or Firm* — Jeffrey G. Sheldon; Cislo & Thomas

(57) ABSTRACT

A packaging sleeve for a bottle includes: a circular bottom wall; a cylindrical lower section attached to the circular bottom wall and an upper section attached to the lower section. The upper section defines fold lines for facilitating the bunching of the upper section closely around the neck of a bottle.

21 Claims, 3 Drawing Sheets

(56) References Cited

U.S. PATENT DOCUMENTS

| | | | | |
|---|---|---|---|---|
| 6,290,091 | B1 * | 9/2001 | Bell | B65D 81/3876 220/739 |
| 6,718,733 | B2 | 4/2004 | Kilmartin | |
| 7,828,195 | B2 | 11/2010 | Edmondson | |
| 2009/0090732 | A1 | 4/2009 | Trimarco | |
| 2014/0097234 | A1 | 4/2014 | Shaw et al. | |

* cited by examiner

PACKAGING SLEEVE FOR A BOTTLE

BACKGROUND OF THE INVENTION

Packaging bags for bottles, such as beverage bottles are well known. The problems with packaging bags of the prior art, however, is that they are difficult to neatly fold around the neck of a bottle, and they are difficult to affix to the neck of the bottle in a secure manner without making it difficult for a user to remove the bottle from the bag.

SUMMARY OF THE INVENTION

The invention addresses this problem. In one aspect, the invention is a packaging sleeve for a bottle, the packaging sleeve comprising: (a) a bottom wall; (b) a cylindrical lower section attached to the bottom wall, the lower section extending upwards from the bottom wall to the upper section, the lower section having a lower section cross-section with a lower section maximum cross-sectional width, the lower section maximum cross-sectional length being equal to or slightly larger than the base maximum cross-sectional width of a bottle which is to be packaged with the packaging sleeve; and (c) a cylindrical upper section attached to the lower section and terminating at an open upper-most end, the upper section defining fold lines for facilitating the folding of the upper section around the neck of a bottle which is to be packaged with the packaging sleeve.

In a second aspect, the invention is a packaged beverage bottle combination comprising: (a) a beverage bottle having a base and a neck, the base having a base height and a circular base cross-section defining a base external diameter; (b) a packaging sleeve surrounding the bottle, the packaging sleeve comprising: (i) a bottom wall; (ii) a cylindrical lower section attached to the bottom wall, the lower section extending upwards from the bottom wall to the upper section, the lower section having a lower section circular cross-section defining a lower section internal diameter, the lower section internal diameter being equal to or slightly larger than the base external diameter of a bottle which is to be packaged with the packaging sleeve; and (iii) a cylindrical upper section attached to the lower section and terminating at an open end, the upper section having a circular cross-section with an upper section internal diameter, the upper section defining fold lines for facilitating the folding of the upper section around the neck of a bottle which is to be packaged with the packaging sleeve, the fold lines comprising a plurality of apertures dimensioned and positioned so that, when the upper section is folded along the fold lines, the apertures form notches capable of accepting and retaining a securing band; and (c) a securing band disposed around the upper section of the packaging sleeve and retained with the apertures in the fold lines to secure the packaging sleeve to the neck of the bottle, the upper section being folded along the fold lines inwardly so as to be in close proximity to the neck of the bottle.

DRAWINGS

These and other features, aspects and advantages of the present invention will become better understood with reference to the following description, appended claims, and accompanying drawings where:

DETAILED DESCRIPTION OF THE INVENTION

Figure 1:
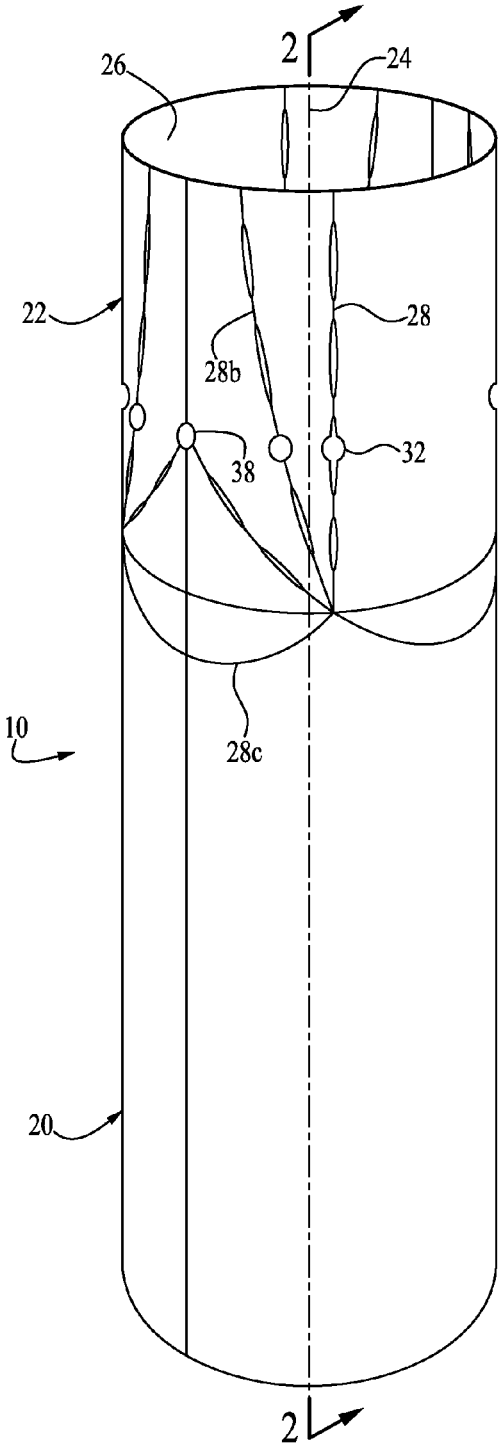
FIG. 1 is a perspective view of a packaging sleeve having features if the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

Definitions

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers, ingredients or steps.

The Invention

In one aspect, the invention is a packaging sleeve 10 for a bottle 12 comprising a base 14 and a neck 16, wherein the base 14 of the bottle 12 has a base height and a base cross-section with a base maximum external cross-sectional width. The packaging sleeve 10 comprises: (a) a bottom wall 18, (b) a cylindrical lower section 20 and a cylindrical upper section 22.

The lower section 20 is joined to the upper section 22 to form a continuous cylinder having a longitudinal axis 24. The cylindrical lower section 20 is attached to the bottom wall 18. The lower section 20 extends upward from the bottom wall 18 to the upper section 24.

The lower section 20 has a lower section cross-section with a lower section maximum cross-sectional width. The lower section maximum cross-sectional length is equal to or slightly larger than the base maximum cross-sectional width of a bottle 12 which is to be packaged with the packaging sleeve 10. By "equal to or slightly larger than" it is meant that the lower section maximum cross-sectional length is between about 90% and about 100% of the base maximum cross-sectional width of a bottle 12 to be packaged within the sleeve 10, more typically between about 95% and about 100% of the base maximum cross-sectional width of a bottle 12 to be packaged within the sleeve 10.

In a typical embodiment, the lower section 20 is circular in cross-section and the bottle 12 which is to be packaged within the sleeve 10 has a circular cross-section. In such embodiment, the lower section 20 of the sleeve 10 defines a lower section internal diameter which is between about 90% and about 100% of the base external diameter of a bottle 12 to be packaged within the sleeve 10, most typically between about 95% and about 100% of the base external diameter of a bottle 12 to be packaged within the sleeve 10.

The upper section 22 is attached to the lower section 20 and terminates at an open end 26. Where the lower section 20 and the upper section 22 have circular cross-sections, it is typical for the lower section internal diameter and the upper section internal diameter to be identical.

The upper section 22 defines fold lines 28 for facilitating the constriction of the upper section 22 to the neck 16 of a bottle 12 to be packaged within the sleeve 10. The fold lines 28 are created in such a way to promote the folding of the upper section 22 in close proximity to the neck 16 of a bottle 12 packaged within the sleeve 10. For example, the fold lines 28 can be scored fold lines 28*a*, grooved fold lines or pre-folded fold lines.

A plurality of the fold lines 28 are disposed so as to run between a lower location proximate to the lower section and an upper location proximate to the open end 26. Such fold lines 28 facilitate the folding of the upper section 22 around the neck 16 of a bottle 12. In the embodiment illustrated in the drawings, such fold lines 28 are typically linear fold lines 28*b*.

The drawings also illustrate a plurality of arcuate fold lines 28*c* which facilitate the folding of the upper section 22 around a converging section 30 where the diameter of the bottle base 14 converges downwardly to the diameter of the bottle neck 16.

The fold lines 28 preferably comprise a plurality of notch precursors 32 dimensioned and positioned so that, when the upper section 22 is folded along the fold lines 28, the notch precursors 32 form notches 34 capable of accepting and retaining a securing band 36. The notch precursors 32 are typically apertures 38, such as apertures 38 having a circular cross-section.

The packaging sleeve 10 can be made from a wide variety of light-weight materials, such as papers, foils and plastics. In one embodiment, the packaging sleeve 10 is made from a 16 pt caliper ultra-smooth paper, such as a 16 pt caliper ultra-smooth Candesce® CIS paper manufactured by Clearwater Paper Corporation of Spokane, Wash. Such paper can be coated with a curable acrylic coating, such as 5129C, BC curable acrylic coating, manufactured by Coating & Adhesives Corporation of Leland, N.C.

Figure 2:
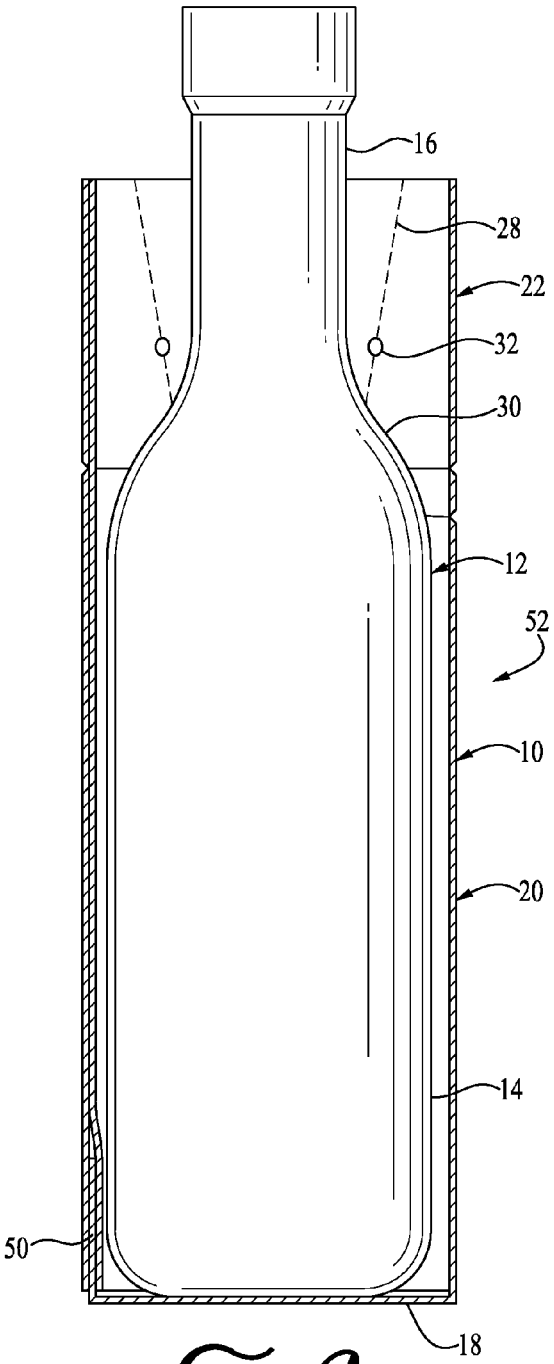
FIG. 2 is a cross-sectional view of the packaging sleeve illustrated in FIG. 1, showing a bottle disposed therein.
Figure 3:
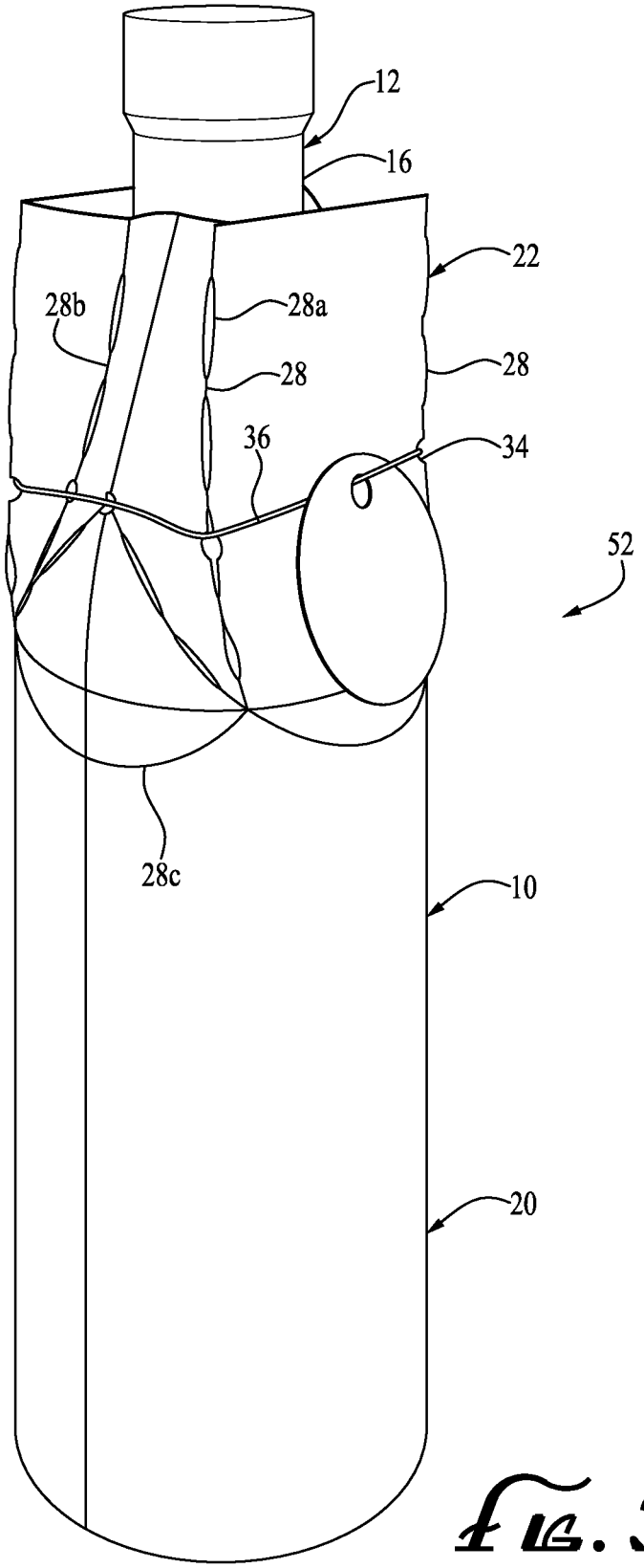
FIG. 3 is a perspective view of a packaging sleeve and bottle combination having features if the invention.
Figure 4:
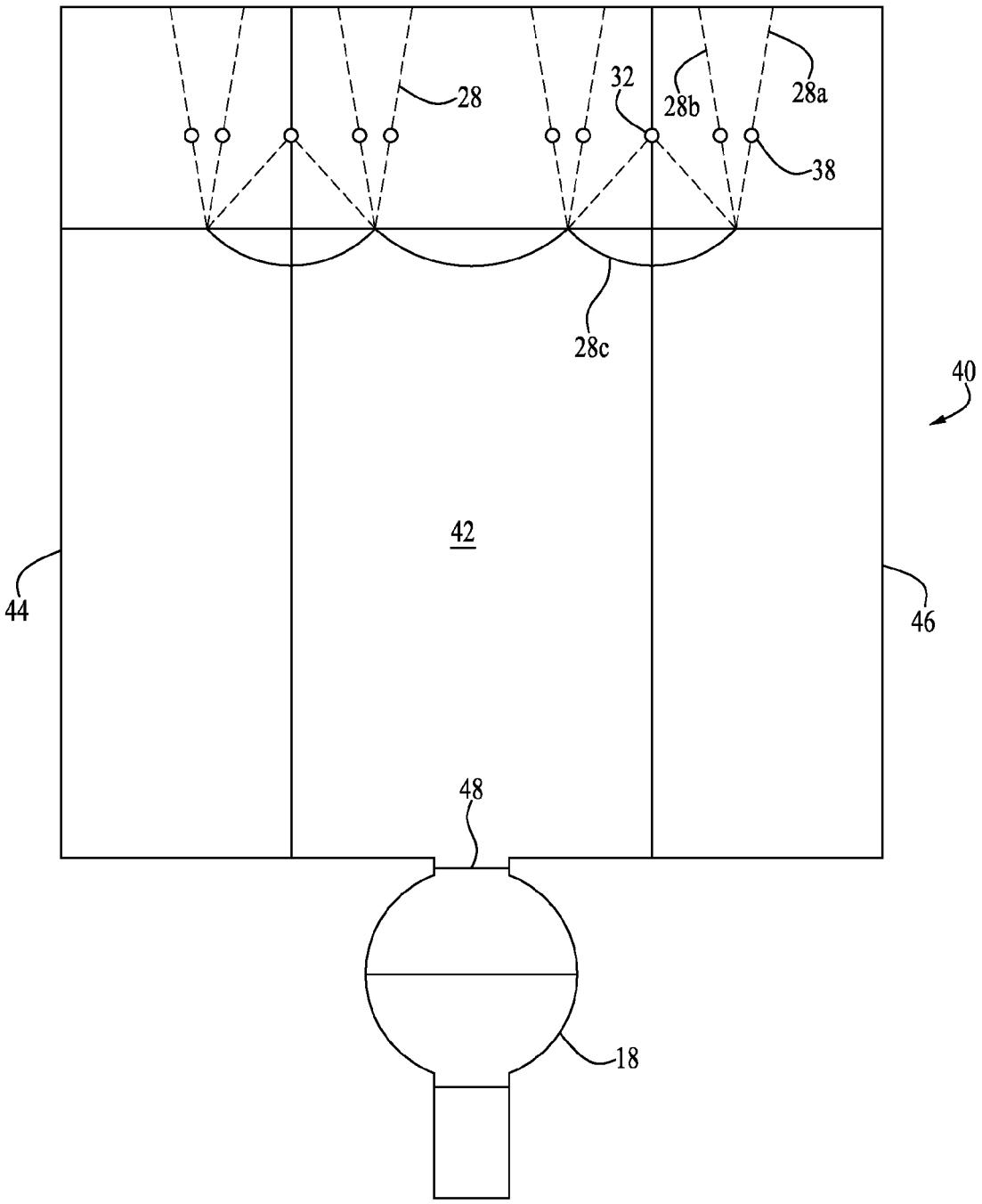
FIG. 4 is a blank useable in the construction of the packaging sleeve illustrated in FIG. 1.

FIG. 4 illustrates a blank 40 used to make the packaging sleeve 10. From the blank 40 the lower and upper sections 20 and 22 of the packaging sleeve 10 can be assembled by forming the center 42 of the blank 40 into a cylinder and then attaching the first blank side edge 44 to the opposed second blank side edge 46. The bottom wall 18 in then folded along a bottom wall fold line 48 to be perpendicular to the longitudinal axis 24 of the sleeve 10 and is attached to the lower section 20. The attachment of the first blank side edge 44 to the second blank side edge 46 and the attachment of the bottom wall 18 to the lower section 20 can be accomplished in many ways, typically by an adhesive 50, as illustrated in FIG. 2. The adhesive 50 can be a water based adhesive, such as a 4002A, B, C, D, -Pink, -Green, -Blue, H, HV water based adhesive manufactured by Coating & Adhesives Corporation of Leland, N.C.

In a second aspect, the invention is packaged bottle combination 52 comprising a bottle 12 disposed within the packaging sleeve 10 described above. The bottle 12 can be a beverage containing bottle, such as a wine bottle. When the bottle 12 is a wine bottle, the bottle 12 typically has an overall height of between about 10 inches and about 20 inches, most typically between about 12 inches and about 15 inches. Wine bottles typically have a base external diameter between 2.5 inches and 5 inches and a neck external diameter between about 1.0 inch and about 2.0 inches. The base 14 is typically between 9 inches and about 12 inches high. The neck 16 of the bottle 12—when a wine bottle—is typically between about 4 and 7 inches—including a lowermost converging section 30 which typically is between about 1.0 inch and about 2.5 inches in height.

In this second aspect of the invention, the fold lines 28 typically comprise a plurality of notch precursors 32, such as apertures 38, which are dimensioned and positioned so that, when the upper section 22 is folded along the fold lines, the precursors 32 form notches 34 capable of accepting and retaining a securing band 36. The upper section 22 is folded along the fold lines 28 inwardly so as to be in close proximity to the neck 16 of the bottle 12, and a securing band 36 is disposed around the upper section 22 of the packaging sleeve 10 and retained with the notches 34 formed by the precursors 32 in the fold lines 28 to secure the packaging sleeve 10 to the neck 16 of the bottle 12. The securing band 36 is typically made from an elastic material.

The invention solves the problems in the prior art by providing a packaging sleeve which can be easily neatly folded around the neck of a bottle, and which can be easily and inexpensively affixed to the neck of a bottle in a secure manner without making it difficult for a user to remove the bottle from the sleeve.

Having thus described the invention, it should be apparent that numerous structural modifications and adaptations may be resorted to without departing from the scope and fair meaning of the instant invention as set forth herein above and described herein below by the claims.

What is claimed is:

1. A packaged wine bottle combination comprising:

a) a wine bottle having a base and a neck, the base having a base height and a circular base cross-section defining a base external diameter, the wine bottle being between 10 to 20 inches in height;

b) a packaging sleeve surrounding the bottle, the packaging sleeve being made of paper and comprising:

i) a circular bottom wall;

ii) a cylindrical lower section attached to the circular bottom wall, the lower section having a longitudinal axis and extending upwards from the bottom wall, the lower section having a lower section circular cross-section defining a lower section internal diameter, the lower section internal diameter being equal to or slightly larger than the base external diameter of a bottle which is to be packaged with the packaging sleeve;

iii) a cylindrical upper section attached to the lower section and terminating at an open end, upper section having a circular cross-section with an upper section internal diameter, the lower section internal diameter and the upper section internal diameter being identical, the cylindrical upper section defining scored fold lines disposed between a lower location proximate to the lower section and an upper location proximate to the open end, the fold lines comprising a plurality of apertures which are dimensioned and positioned so that, when the upper section is folded along the fold lines, the apertures form notches capable of accepting and retaining a securing band, the upper section being folded along the fold lines inwardly so as to be in close proximity to the neck of the bottle; and iv) wherein the bottom wall has a diameter equal to or larger than the diameter of the wine bottle base and foldable along a bottom wall fold line creating a gap between the bottom wall and the cylindrical lower section; and c) an elastic securing band disposed around the upper section of the packaging sleeve and retained within the notches formed by the apertures in the fold lines to secure the packaging sleeve to the neck of the bottle wherein the neck of the bottle is still visible after the packaging sleeve is secured.

2. A packaging sleeve for a bottle, wherein the bottle has a base and a neck, the base having a base height and a base cross-section with a base maximum cross-sectional width, the packaging sleeve comprising:

a) a cylindrical lower section attached to a circular bottom wall, the lower section extending upwards from the bottom wall, the lower section having a lower section cross-section with a lower section maximum cross-sectional width, the lower section maximum cross-sectional width being equal to or slightly larger than the base maximum cross-sectional width of a bottle which is to be packaged with the packaging sleeve; and b) a cylindrical upper section attached to the lower section and terminating at an open end, the cylindrical upper section defining fold lines disposed between a lower location proximate to the lower section and an upper location proximate to the open end, wherein the fold lines comprise a plurality of notch precursors dimensioned and positioned so that, when the upper section is folded along the fold lines, the notch precursors form notches capable of accepting and retaining a securing band; and wherein the circular bottom wall has a diameter equal to or larger than the width of the bottle and foldable along a bottom wall fold line forming a gap between the bottom wall and the cylindrical lower section.

3. The packaging sleeve of claim 2 wherein the lower section has a circular cross-section with a lower section internal diameter and the upper section has a circular cross-section with an upper section internal diameter.

4. The packaging sleeve of claim 2 wherein the fold lines comprise linear fold lines.

5. The packaging sleeve of claim 2 wherein a plurality of the fold lines are scored.

6. The packaging sleeve of claim 2 wherein the notch precursors are apertures.

7. The packaging sleeve of claim 2 wherein the notch precursors are apertures having a circular cross-section.

8. The packaging sleeve of claim 2, wherein the fold lines facilitate the folding of the upper section around the neck of the bottle.

9. A packaging sleeve for a bottle, wherein the bottle has a base and a neck, the base having a base height and a base cross-section with a base maximum cross-sectional width, the packaging sleeve comprising:

a) a cylindrical lower section attached to a circular bottom wall, the lower section extending upwards from the bottom wall, the lower section having a lower section cross-section with a lower section maximum cross-sectional width, the lower section maximum cross-sectional width being equal to or slightly larger than the base maximum cross-sectional width of a bottle which is to be packaged with the packaging sleeve; and b) a cylindrical upper section attached to the lower section and terminating at an open end, the cylindrical upper section defining arcuate fold lines disposed between a lower location proximate to the lower section and an upper location proximate to the open end;

wherein the circular bottom wall has a diameter equal to or larger than the width of the bottle and foldable along a bottom wall fold line forming a gap between the bottom wall and the cylindrical lower section.

10. The packaging sleeve of claim 9 wherein the lower section has a circular cross-section with a lower section internal diameter and the upper section has a circular cross-section with an upper section internal diameter.

11. The packaging sleeve of claim 9, wherein the fold lines facilitate folding of the upper section around the neck of the bottle.

12. A packaging sleeve for a bottle, wherein the bottle has a base and a neck, the base having a base height and a circular base cross-section defining a base external diameter, the packaging sleeve comprising:

a) a circular bottom wall;

b) a cylindrical lower section attached to the circular bottom wall, the lower section extending upwards from the bottom wall, the lower section having a lower section circular cross-section defining a lower section internal diameter, the lower section internal diameter being equal to or slightly larger than the base external diameter of a bottle which is to be packaged with the packaging sleeve;

c) a cylindrical upper section attached to the lower section and terminating at an open end, the upper section having a circular cross-section with an upper section internal diameter, the lower section internal diameter and the upper section internal diameter being identical, the upper section defining fold lines disposed between a lower location proximate to the lower section and an upper location proximate to the open end, the fold lines comprising a plurality of apertures sized, dimensioned and positioned so that, when the upper section is folded along the fold lines, the apertures form notches capable of accepting and retaining a securing band; and d) wherein the circular bottom wall has a circumference equal to or larger than the width of the bottle and foldable along a bottom wall fold line creating an opening between the circular bottom wall and the cylindrical lower section.

13. The packaging sleeve of claim 12 wherein the fold lines comprise linear fold lines.

14. The packaging sleeve of claim 12 wherein a plurality of the fold lines are scored.

15. The packaging sleeve of claim 12 wherein the fold lines comprise arcuate fold lines.

16. A packaged beverage bottle combination comprising:

a) a beverage bottle having a base and a neck, the base having a base height and a circular base cross-section defining a base external diameter;

b) a packaging sleeve surrounding the bottle, the packaging sleeve comprising:

i) a circular bottom wall;

ii) a cylindrical lower section attached to the circular bottom wall, the lower section extending upwards from the bottom wall, the lower section having a lower section circular cross-section defining a lower section internal diameter, the lower section internal diameter being equal to or slightly larger than the base external diameter of a bottle which is to be packaged with the packaging sleeve;

iii) a cylindrical upper section attached to the lower section and terminating at an open end, the upper section having a circular cross-section with an upper section internal diameter, the lower section internal diameter and the upper section internal diameter being identical, the cylindrical upper section defining fold lines disposed between a lower location proximate to the lower section and an upper location proximate to the open end, the fold lines comprising a plurality of apertures dimensioned and positioned so that, when the upper section is folded along the fold lines, the apertures form notches capable of accepting and retaining a securing band, the upper section being folded along the fold lines inwardly so as to be in close proximity to the neck of the bottle; and iv) wherein the circular bottom wall has a diameter equal to or larger than the width of the bottle and foldable along a bottom wall fold line forming a gap between the bottom wall and the cylindrical lower section; and c) a securing band disposed around the upper section of the packaging sleeve and retained with the notches formed by the apertures in the fold lines to secure the packaging sleeve to the neck of the bottle.

17. The combination of claim 16 wherein the securing band is made from an elastic material.

18. The combination of claim 16 wherein the fold lines comprise linear fold lines.

19. The combination of claim 16 wherein the fold lines comprise arcuate fold lines.

20. The combination of claim 16 wherein a plurality of the fold lines are scored.

21. The combination of claim 16 wherein the apertures have a circular cross-section.

* * * * *